US009995096B2

(12) United States Patent
Seweryn et al.

(10) Patent No.: US 9,995,096 B2
(45) Date of Patent: Jun. 12, 2018

(54) DRILLING HEAD DRIVING DEVICE, TUBE FORMING MECHANISM AND DRILLING METHOD

(71) Applicants: CENTRUM BADAN KOSMICZNYCH POLSKIEJ AKADEMII NAUK, Warsaw (PL); AKADEMIA GORNICZO-HUTNICZA IM. STANISLAWA STASZICA W KRAKOWIE, Cracow (PL)

(72) Inventors: Karol Seweryn, Cracow (PL); Kamil Grassmann, Bialystok (PL); Tomasz Kucinski, Elk (PL); Tomasz Buratowski, Cracow (PL); Tadeusz Uhl, Wieliczka (PL); Adam Jan Zwierzynski, Cracow (PL); Wojciech Teper, Nowy Targ (PL); Stanislaw Bednarz, Mogilany (PL); Andrzej Gonet, Cracow (PL); Miroslaw Rzyczniak, Cracow (PL); Albert Zlotkowski, Czestochowa (PL)

(73) Assignees: CENTRUM BADAN KOSMICZNYCH POLSKIEJ AKADEMII NAUK, Warsaw (PL); AKADEMIA GORNICZO-HUTNICZA IM. STANISLAWA STASZICA W KRAKOWIE, Cracow (PL)

( * ) Notice: Subject to any disclaimer, the term of this patent is extended or adjusted under 35 U.S.C. 154(b) by 296 days.

(21) Appl. No.: 14/779,381

(22) PCT Filed: Oct. 22, 2014

(86) PCT No.: PCT/IB2014/065537

§ 371 (c)(1),
(2) Date: Sep. 23, 2015

(87) PCT Pub. No.: WO2015/097575

PCT Pub. Date: Jul. 2, 2015

(65) Prior Publication Data

US 2016/0047182 A1 Feb. 18, 2016

(30) Foreign Application Priority Data

Dec. 23, 2013 (PL) ..... 406633

(51) Int. Cl.

| | |
|---|---|
| ***E21B 19/22*** | (2006.01) |
| ***E21B 7/20*** | (2006.01) |
| ***E21B 17/20*** | (2006.01) |
| *E21B 25/00* | (2006.01) |

(52) U.S. Cl.

CPC ..... *E21B 19/22* (2013.01); *E21B 7/20* (2013.01); *E21B 17/20* (2013.01); *E21B 25/00* (2013.01)

(58) Field of Classification Search

CPC ..... E21B 19/22; E21B 17/20; E21B 7/20
See application file for complete search history.

(56) References Cited

U.S. PATENT DOCUMENTS

| | | | |
|---|---|---|---|
| 2,934,130 | A | 4/1960 | Lane et al. |
| 4,154,310 | A | 5/1979 | Konstantinovsky |

(Continued)

FOREIGN PATENT DOCUMENTS

| | | | |
|---|---|---|---|
| DE | 102007008373 | A | 8/2008 |
| DE | 202011050417 | U1 | 6/2012 |

(Continued)

OTHER PUBLICATIONS

International Search Report for PCT/1B2014/065537 dated Nov. 5, 2015.
Polish Search Report for Polish patent counterpart application No. P406633 dated Mar. 13, 2014.

*Primary Examiner* — Giovanna C. Wright
*Assistant Examiner* — Kristyn A Hall
(74) *Attorney, Agent, or Firm* — Browdy and Neimark, PLLC

(57) ABSTRACT

A tube forming mechanism for application in a tube is provided with a band and clamping mechanism. The clamp- (Continued)

ing mechanism is arranged within the tube, outside of which the band. A system for guiding a bore head is provided, including the tube forming mechanism, a head, mechanism transferring the pressing force to the bore head, and also a curled tube fed from the drum into the wellbore to transfer the pressing force exerted by the pressing mechanism via a mechanism releasably connected to the curled tube. A method of drilling a wellbore is described, wherein a bore head with a drill bit is lowered down the wellbore and pressed against its bottom, simultaneously inserting a tube into to wellbore. For pressing the head with the drill bit, a curled strip tube drawn from a drum is used, wherein the pressing force is applied to the tube via a mechanism releasably connected thereto.

5 Claims, 6 Drawing Sheets

(56) References Cited

U.S. PATENT DOCUMENTS

| | | | |
|---|---|---|---|
| 4,166,508 | A | 9/1979 | Van Den Berg |
| 5,154,310 | A | 10/1992 | Massey |
| 5,169,264 | A | 12/1992 | Kimura |
| 2011/0265941 | A1 | 11/2011 | Jiral et al. |

FOREIGN PATENT DOCUMENTS

| | | | |
|---|---|---|---|
| GB | 644516 | A | 10/1950 |
| GB | 2455285 | A | 6/2009 |
| PL | 348360 | A1 | 5/2002 |
| WO | 2000-28249 | A1 | 5/2000 |
| WO | 2012/126658 | A1 | 9/2012 |

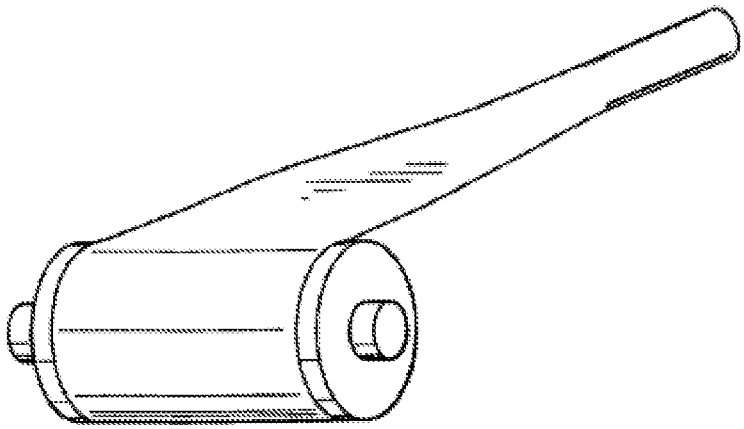
Fig. 1a (state of the art)
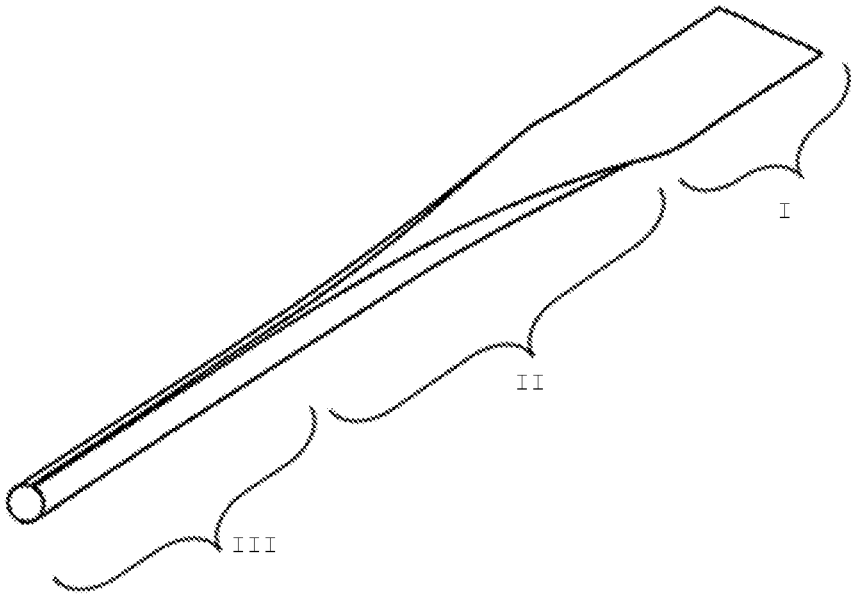
Fig. 1b (state of the art)

DRILLING HEAD DRIVING DEVICE, TUBE FORMING MECHANISM AND DRILLING METHOD

FIELD

The object of the invention is a tube forming mechanism, a drilling head driving system and a method of drilling. More precisely, the object of the invention is a drilling head driving system and a method of drilling, both adapted for application in difficult conditions, including drilling in space and from unmanned vehicles.

BACKGROUND

Drilling systems are used for drilling oil wells and carrying out geological boreholes. In the latter case often a sample of ground is collected in the form of a core extracted from the hole formed in the so-called coring operation. Such operations are sometimes performed in hardly accessible spots, or even in space. The drilling rig is then transported by a piloted or unmanned craft, a satellite or a lander. In these applications the key parameter of the drilling rig is its mass and power consumption, which have to be minimised.

In the case of drilling with casing tube, after extracting the output a tube is placed in the drilled hole. In ground conditions sometimes subsequent sections of the rigid tube are inserted into the borehole. In conditions of work performed from a vehicle this is difficult or even impossible. In the art is known the application of so-called curled strips for casing.

Curled strip tubes have numerous applications in devices adapted to change of length, which have to combine simultaneously small mass and high durability and high stiffness. This relates in particular to booms, manipulators and antennas used in aviation and space exploration. A tube made of elastic material, i.e. a material with a high yield strength, e.g. spring steel, which after straightening and winding on a drum has small size and mass. Being drawn it returns to its nominal form in which it was hardened. In this way, after unwinding the strip from the drum a structure constituting a thin-walled tube reappears, which is characterised by very advantageous flexural strength to mass ratio. A disadvantage of this construction is that the strip is vulnerable to damage due to loads transferred by region II shown in FIG. 1*b*, where the strip changes its shape from flat to cylindrical, near the drum on which it is wound. Under a load applied to the strip in this region, damage can occur easily. This problem can be solved easily in the case of loads acting in perpendicular to the curled strip tube's axis. The most typical solution is an application of an additional stiffening in the form of a sliding ring or rollers through which the strip passes. However, such solution does not provide protection against loads acting along the tube's axis.

Documents U.S. Pat. No. 4,154,310A and U.S. Pat. No. 4,108,258A disclose drilling systems, wherein curled tubes for attenuation of vibrations and as casing have been applied.

A significant portion of the drilling system's mass is due to the head pressing system, which has to be long, stiff and allow to transfer heavy loads, in the range of 100 N to 500 N. Such loads acting along the axis of the wellbore exceed the durability of typical curled strip constructions. It is commonly known to those skilled in the art, that curled strip tubes subjected to such loads become damaged in the transition region.

SUMMARY

The aim of the invention is to provide a possibility to reduce the mass of a drilling system providing the possibility to easily introduce into the wellbore being drilled a casing tube, which protects the wellbore against being filled up in transition through loose layers.

The aim of the invention is achieved by providing a tube forming mechanism for application in a tube, provided with a band and clamping means. The clamping means are located inside the tube, on the outer side of which the band is located. Preferably the clamping means is a drive pressing jaws to the inner wall of the tube. Preferably the jaws have the surfaces contacting the walls of the tube covered with a material having high static friction coefficient.

The aim of the invention is also achieved by providing a drilling head driving system, provided with a pressing mechanism, a head, means transferring the pressing force to the bore head and a curled strip tube fed from a drum into the wellbore. The curled tube fed from the drum into the wellbore constitutes the means transferring the pressing force. The pressing force is transferred by the pressing mechanism via a mechanism releasably connected to the curled tube. Preferably the mechanism releasably connected to the curled tube comprises a tube forming mechanism located within the tube, provided with a band and clamping means. The clamping means are located within the tube, on the outer side of which the band is located. Preferably the clamping means is a drive pressing jaws to the inner wall of the tube. Preferably the jaws have the surfaces contacting the walls of the tube covered with a material having a high static friction coefficient.

If the curled tube is partially open, then the connection between the tube forming mechanism and the pressing mechanism can be implemented as an interface moveable within the opening of the curled tube.

Preferably the system according to the invention is further provided with a casing tube curled of a strip wound on a drum, wherein the first curled tube and casing curled tube are substantially coaxial. The diameter of the casing tube is greater than the diameter of the first curled tube. Ends of the curled tube and the casing curled tube cooperate with each other via an interface transferring force directed from the drum, exerted by the end of the curled tube on the end of the casing curled tube. Preferably the interface comprises an element connected to the head and an element connected with the casing curled tube, releasable upon a force directed to the surface, applied to the element connected to the head.

The aim of the invention is also achieved by the application of a method of drilling, wherein a bore head with a drill bit is lowered into the wellbore and pressed against its bottom, simultaneously introducing a tube into the wellbore. For pressing the head with the drill bit a tube curled of a strip drawn from a drum is used. The pressing force is applied to the curled tube via a releasably connected mechanism. This comprises a tube forming mechanism according to the invention.

Preferably to the curled tube there is attached a casing tube curled of a strip drawn from a second drum, wherein an end of the casing tube connects to an end of the curled tube by means of an interface transferring to the end of the casing tube a force directed down the hole, exerted by the end of the curled tube.

Elimination of heavy pressing systems allows to reduce the weight of the whole drilling system, wherein the guiding system, tube forming mechanism or the method according to the invention is used. In proposed solution the portion of the curled tube not in use is stored in the form of a flat strip wound on a drum, therefore the application of curled tubes as drilling head driving system significantly reduces the volume of the system in comparison to known solutions, wherein connected steel tubes are used. The application of curled tubes is less failure prone than currently known and applied solutions, because the change of the drilling depth requires only to rotate the drum on which the curled is located and does not require the application of any releasable interfaces between consecutive segments of the well path.

BRIEF DESCRIPTION OF THE DRAWINGS

The object of the invention has been shown in embodiments in the figures, wherein FIG. 1 shows strips curled into tubes known in the state of the art.

DETAILED DESCRIPTION

A curled strip mechanism known in the state of the art is shown in FIG. 1*a*. Experiments have proven that although the required head pressing force causes a deformation of the strip's transition region II, shown in FIG. 1*b*, the same force can be transferred without any damage by the section III of the strip after it has been completely curled into a tube. The application of the tube forming mechanism in a curled tube makes it possible to use it simultaneously for two purposes: to provide protection of the wellbore against wall subsidence and to provide the head pressing force.

Figure 2:
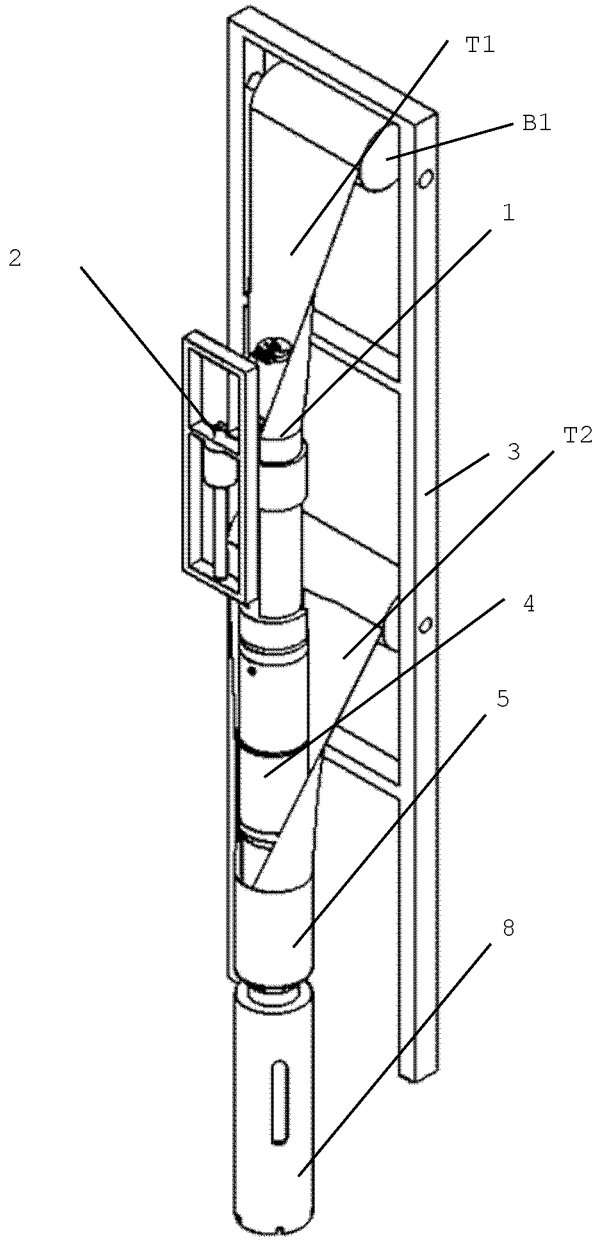
FIG. 2 shows a drilling head driving system.

The drilling head driving system according to the invention has been shown in FIG. 2. In this system two curled tubes have been used: the first curled tube 1 and the second curled tube 5. The first tube 1 curled of strip T1 and second tube 5 curled of strip T2 are arranged coaxially, and the drums, on which the strips T1 and T2 are wound, are separated by 150 mm. This separation provides the possibility of free deployment of the strip T2 and change of profile from flat to C-shaped. The curled tube 1 is provided with a tube forming mechanism 11, which is connected via an interface 13 accommodated in the opening of the curled tube 1, with a pressing mechanism 2 providing a force pressing the tube 1 in the direction down the wellbore. A bore head is attached to an end of the curled tube 1. The free ends of the curled tube 1 and curled tube 2 are connected to each other via a unidirectional interface 6, 7. This interface transfers down the wellbore the pressing force applied via the end of the first curled tube 1 to the end of the second curled tube 5. Hence a stimulated movement down the wellbore of the first curled tube 1 causes also the second curled tube 5 to move down the wellbore. The interface 6, 7 disengages under the influence of the force exerted on the first curled tube 1, directed up, to the outside of the wellbore. Thereby it allows to pull out the bore head and the first curled tube 1 from the wellbore, while leaving in it the second curled tube 5. The presence of the curled tube 5 prevents that the walls of the wellbore from collapsing and enables pulling the head out by winding the strip T1 curled in the tube 1 back onto the drum B1.

Figure 3A:
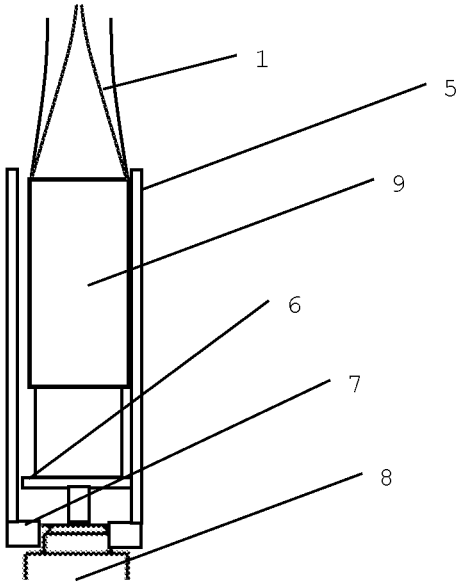
FIG. 3*a* shows an interface between a casing strip and a strip responsible for the bore head's movement.

The interface 6, 7 shown in FIG. 3*a* is in charge of pulling the casing tube 5 formed of the drawn strip T2 down the wellbore as the tube 1 curled of the strip T1 moves. The interface essentially comprises two parts. The first element 6 of the interface is attached to the curled tube 5 at its end. The element 6 has its internal diameter less than the internal diameter of the casing tube 5. The second element 7 of the interface is attached to a non-rotating part of the bore head. Its external diameter is chosen so that during the movement of the bore head down the wellbore the surface 'A' of the interface element 6 supports on the surface 'B' of the interface element 7. In this way a movement of the tube 1 down the drilled wellbore causes a force directed down the wellbore to be applied to the casing curled tube 5.

If the bore head is intended to be permanently left in the wellbore, the solution according to the invention can be simplified, applying only the first curled tube 1 without the casing curled tube 5. In this embodiment of the invention, the curled tube 1 acts as a casing tube after the drilling is complete. Then, the drill bit 8 and the head 9 can be coupled permanently. The drill bit 8 can be a bit, a drill, or any other tool applicable in drilling holes known in the state of the art.

In another embodiment of the method according to the invention, before beginning drilling the tube 1 is connected to the casing tube 5. The casing tube 5 is curled of strip T2 drawn from the second drum. Tubes 1 and 5 are connected via the interface 6, 7 so that a movement of the tube 1 downwards is related to application of a force acting downwards to the tube 5, and in consequence drawing the strip T2 from the drum.

Figure 5A:
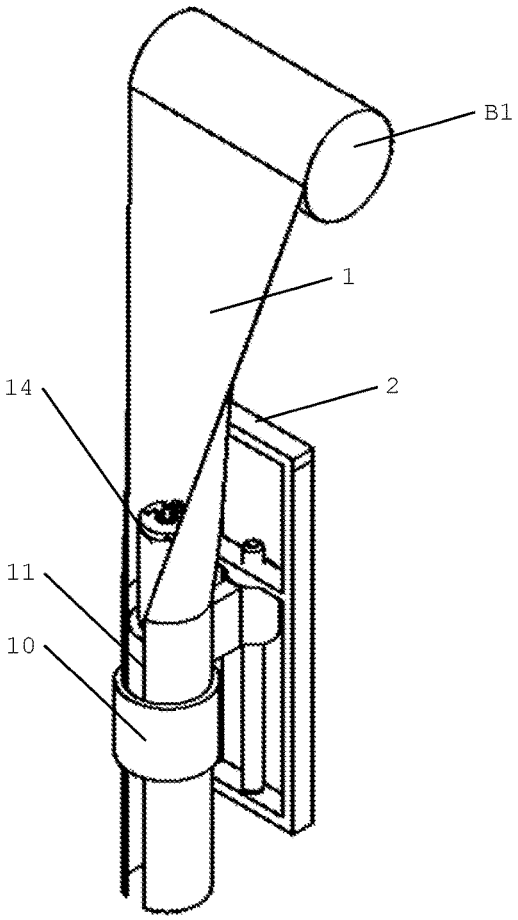
FIG. 5*a* shows a tube forming mechanism according to the invention, having a curled tube and a securing band.
Figure 5B:
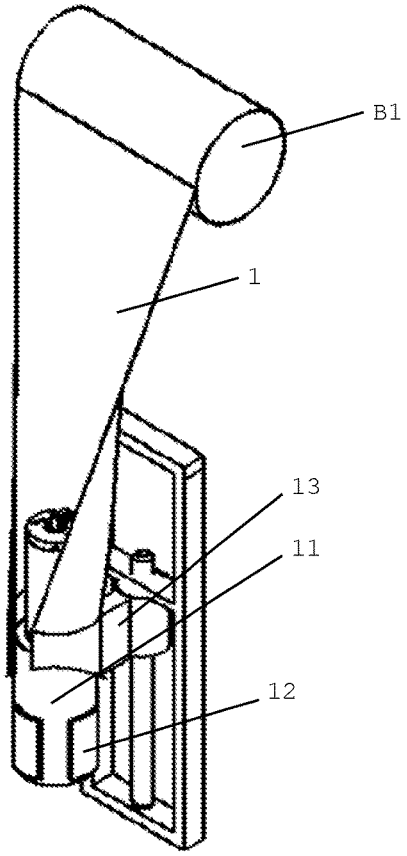
FIG. 5*b* shows the tube forming mechanism according to the invention, without the securing band and the lower part of the curled tube.
Figures 6A, 6B:
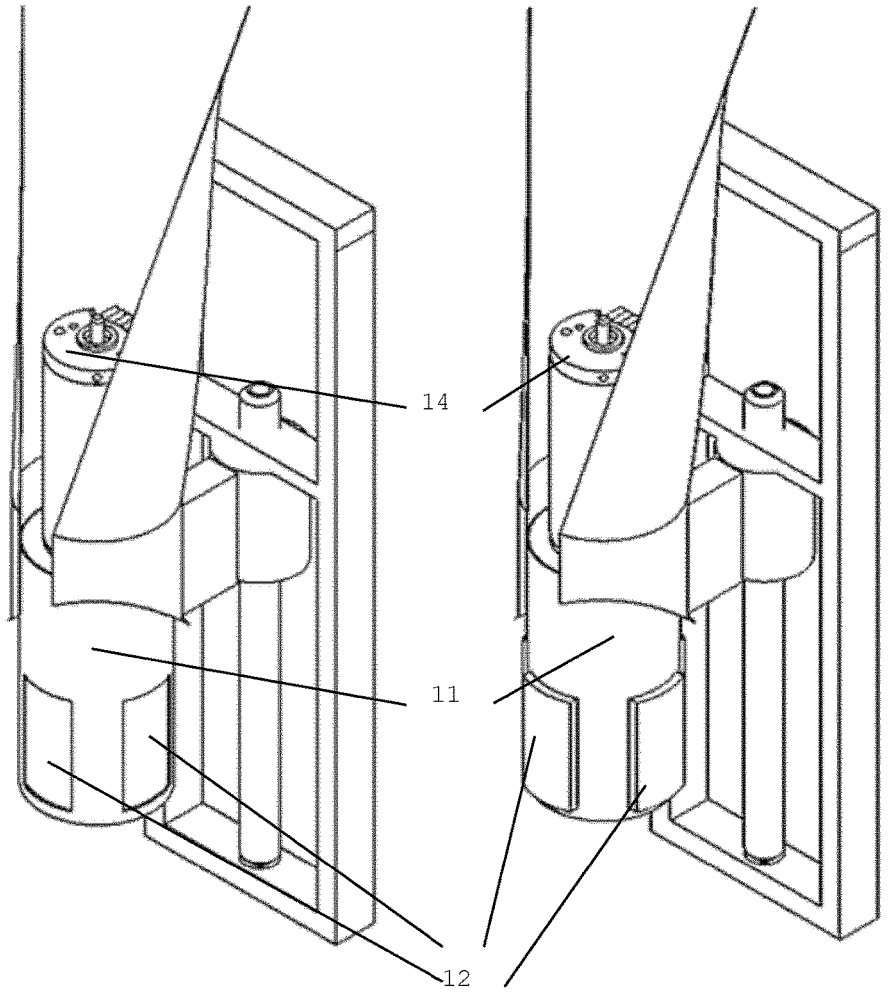
FIG. 6*a* shows the spagging mechanism according to the invention with jaws in the inserted position.
FIG. 6*b* shows the tube forming mechanism according to the invention with jaws in the expanded position.

FIG. 5*a* shows a tube forming mechanism according to the invention. This mechanism is almost completely located inside the curled tube 1 and is adapted to cooperate with means intended for exerting pressing force known in the state of the art. Outside of the curled tube 1 only a moulder 10 is located. The moulder diameter corresponds to the nominal external diameter of the curled tube 1. The moulder 10 prevents the tube from buckling under the operation of the tube forming mechanism 11.

The tube forming mechanism 11 is provided with at least two jaws 12. The jaws 12 are arranged inside the structure of the tube forming mechanism 11 so that they could be pressed to the inner walls of the tube. Covering the surface of the jaws contacting with the inside of the curled tube 1 with a material having a high static friction coefficient makes it possible to increase the maximal pressing force that the mechanism is able to transfer. The mechanism 11 is also provided with a drive 14 adapted to press the jaws 12 outwards from the axis of the curled tube 1. Thus, the pressing mechanism 2 transfers the pressing force to the tube forming mechanism 11, which transfers it to the section of strip T1, which is already curled in the curled tube 1, and via the tube to the bore head. The transition section II of the strip T1 does not participate in transferring the pressing force. The application as the curled tube 1 of a strip curled into a partially open tube allows for an easier attachment of the tube forming mechanism to the mechanism providing the longitudinal force. In this situation it is sufficient to apply only an interface 13 moveable inside the opening of the tube. By means of the interface 13 the pressing mechanism 2 moves the pressing mechanism down the wellbore.

Under the operation of the drive 14 the jaws 12 move towards the inner wall of the curled tube 1, causing the tube 1 to become jammed between the jaws and the outer moulder 10. Due to large friction it is possible to transfer a large force along the tube 1.

In the first embodiment of the method of drilling according to the invention, the head 9 drilling the hole is being pressed to the hole's bottom by means of the tube 1 curled of the strip T1 drawn from the drum. The pressing force is applied to the tube 1 by means of the pressing mechanism 2 attached to any mechanism known in the state of the art which is suitable for jamming on a thin-walled tube. After completion of the drilling, the head remains at the bottom of the wellbore, and the tube 1 secures its walls. A person skilled in the art could propose numerous mechanisms and methods allowing to disengage the curled tube 1 and the head 9 after completion of the drilling and pull it out, e.g. by means of a string. Then, a wellbore reinforced with a tube would remain. However, it would not be possible to insert again the same head and increase the depth the same way, what is required by the application of the known in the art coring bit, i.e. the so-called core barrel.

Figure 3B:
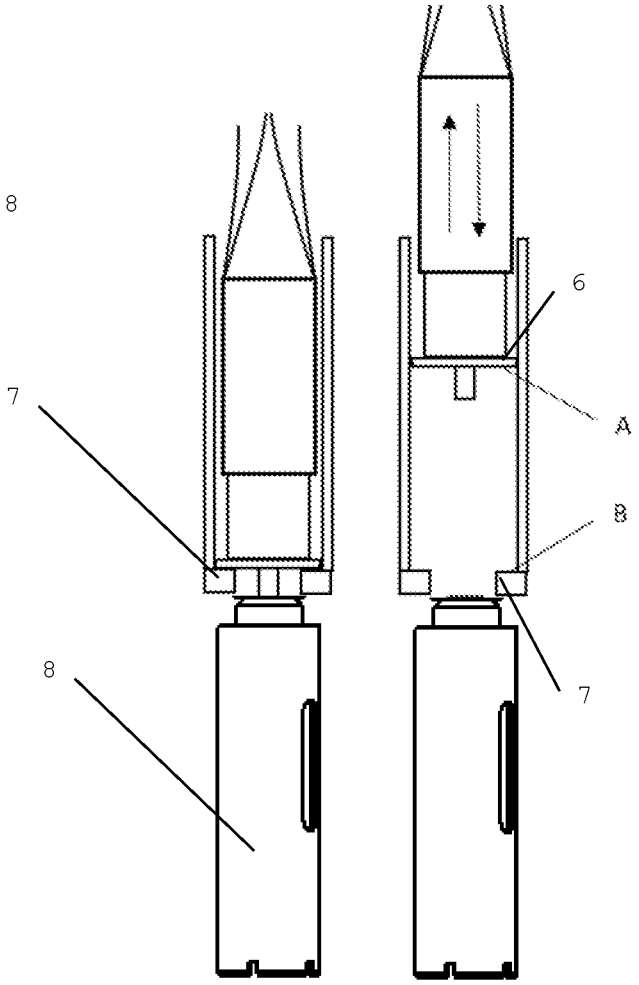
FIG. 3*b* shows schematically the operation of the interface.
Figure 4:
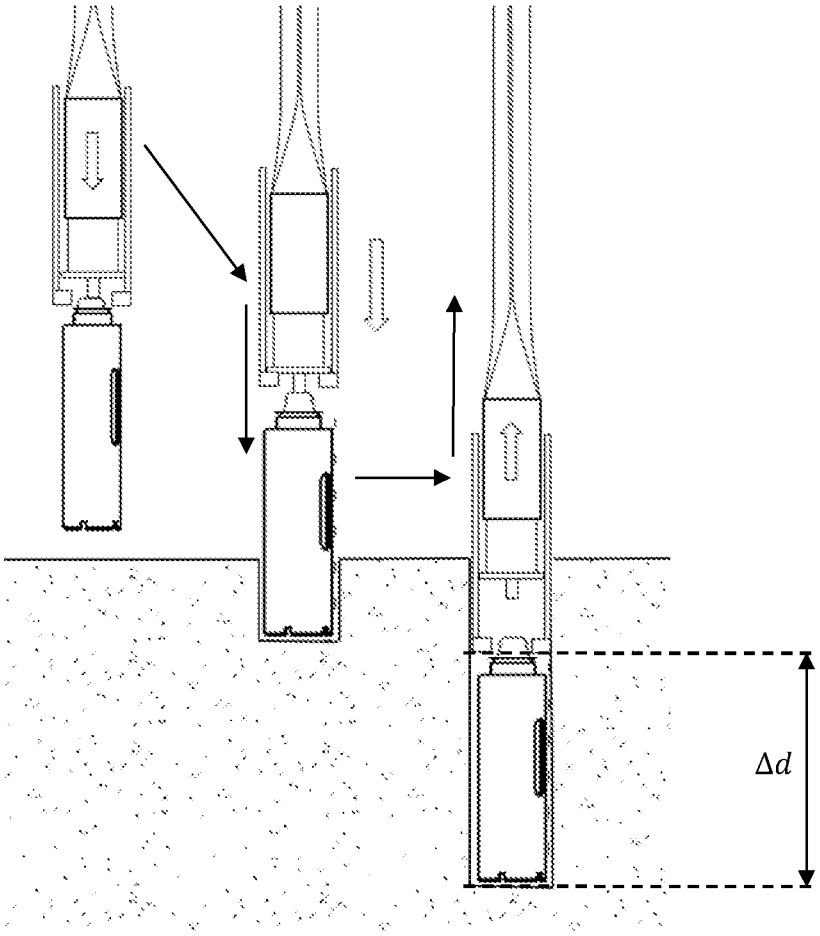
FIG. 4 shows schematically an embodiment of the method of drilling according to the invention.

This problem is solved by another embodiment of the method of drilling according to the invention, wherein an embodiment of the head guiding system provided with two curled tubes 1 and 5 is used. This embodiment of the method according to the invention has been described below, with reference to FIG. 3*a*, FIG. 3*b* and FIG. 4. The following steps can be distinguished therein:

I) In the first step of drilling, the strip T1 is unrolled forming a tube 1 having the bore head 9 attached to its end. In the upper portion of the tube, the tube forming mechanism 11 is arranged, which is used to exert upon the curled tube 1 a force directed down the wellbore, the force being applied via the pressing mechanism 2. Thereby the bore head and the known in the state of the art drill bit 8 mounted therein are being pressed to the ground being wined.

II) After drilling to the depth of Δd, the strip T1 is wound onto the drum B1, resulting in pulling the curled tube 1 out of the wellbore. In result, the interface 6, 7 disengages. Also the coupling of the head 9 to the tool 8 known in the state of the art disengages.

III) After pulling the head out onto the surface, the core is recovered and then the head is inserted again to the bottom of the wellbore by means of the strip T1.

IV) When the bore head 9 reaches the bottom of the wellbore, the bore head and the tool connect and the drilling starts again. Then, the surfaces A and B of the elements 6 and of the interface contact. Due to this the movement of the tube 1 downwards stimulates the casing tube 5 to penetrate deeper. The strip T2 is drawn from the drum and the casing tube elongates.

V) After subsequent penetrating deeper by Δd the cycle is repeated.

In this embodiment of the method according to the invention the steps I to V are repeated until the wellbore reaches the desired depth.

During the drilling process a moment of reaction force of the rotating core barrel acts on the bore head. This torque requires compensation by the bore head, e.g. by the application of an anchoring mechanism known in the state of the art, allowing to transfer the torque to the walls of the wellbore.

The invention claimed is:

1. A drilling head driving system, comprising:

a pressing mechanism, a head, means transferring the pressing force to the bore head, and a curled tube fed from a drum to a wellbore, wherein the means transferring the pressing force comprises the curled tube fed from the drum into the wellbore, and the pressing force is transferred by the pressing mechanism via a mechanism releasably connected to the curled tube, the mechanism releasably connected to the curled tube comprising a tube forming mechanism arranged within the curled tube, the tube forming mechanism comprising a band and clamping means, wherein the clamping means are arranged within the curled tube, outside of which the band is arranged, and wherein the curled tube is partially open, and the connection between the tube forming mechanism and the pressing mechanism constitutes an interface which is able to move in the opening of the curled tube.

2. A system according to claim 1, further comprising a casing tube curled of a strip wound on the drum, wherein the curled tube and the casing tube are coaxial, and the diameter of the casing tube is greater than the diameter of the curled tube, wherein ends of the curled tube and the casing tube cooperate with each other via an interface, which transfers the force directed from the drum, which is exerted by the end of the curled tube on the end of the casing tube.

3. A system according to claim 2, wherein the interface comprises a first element connected to the head and a second element connected to the casing tube, releasable under the force directed towards the surface, applied to the first element.

4. A method of drilling a wellbore, comprising lowering a bore head with an drill bit down the wellbore, pressing the bore head against a bottom of the wellbore, while simultaneously inserting a curled tube into the wellbore, wherein the pressing of the bore head with the drill bit (8) comprises applying a tube curled of a strip drawn from a drum, and applying a pressing force to the tube via a mechanism releasably connected thereto, the method further comprising connecting a casing tube curled of the strip drawn from the drum to the curled tube, connecting an end of the casing tube with an end of the curled tube by the interface, and transferring to the end of the casing tube the force directed down the wellbore exerted by the end of the curled tube.

5. A method according to claim 4, wherein the mechanism releasably connected to the curled strip comprises a tube forming mechanism comprising a band and clamping means, wherein the clamping means are arranged within the tube, outside of which the band (10) is arranged.

* * * * *